US008791312B2

(12) United States Patent
Randolph et al.

(10) Patent No.: US 8,791,312 B2
(45) Date of Patent: Jul. 29, 2014

(54) PROCESS FOR UPGRADING HYDROCARBONS

(75) Inventors: Bruce B. Randolph, Bartlesville, OK (US); Bruce Welch, Greenbrier, AR (US); Roland Schmidt, Bartlesville, OK (US); Edward L. Sughrue, II, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 147 days.

(21) Appl. No.: 13/156,475

(22) Filed: Jun. 9, 2011

(65) Prior Publication Data

US 2011/0263915 A1 Oct. 27, 2011

Related U.S. Application Data

(63) Continuation-in-part of application No. 12/607,809, filed on Oct. 28, 2009, now abandoned.

(60) Provisional application No. 61/109,700, filed on Oct. 30, 2008.

(51) Int. Cl.

| | |
|---|---|
| ***C07C 6/00*** | (2006.01) |
| ***C10L 1/04*** | (2006.01) |
| ***C10G 35/04*** | (2006.01) |
| ***C10G 50/00*** | (2006.01) |
| ***C10L 1/06*** | (2006.01) |
| ***C10G 29/20*** | (2006.01) |

(52) U.S. Cl.

CPC ..... *C10G 29/205* (2013.01); *C10G 35/04* (2013.01); *C10G 2400/02* (2013.01); *C10G 50/00* (2013.01); *C10L 1/06* (2013.01); *C10G 2300/4081* (2013.01); *C10G 2300/202* (2013.01)

USPC ..... 585/16; 585/310; 585/313; 585/708

(58) Field of Classification Search

USPC ..... 585/16, 324

See application file for complete search history.

(56) References Cited

U.S. PATENT DOCUMENTS

| | | | | |
|---|---|---|---|---|
| 3,763,032 | A * | 10/1973 | Banks | 208/93 |
| 3,767,565 | A * | 10/1973 | Banks | 208/93 |
| 4,522,936 | A * | 6/1985 | Kukes et al. | 502/249 |
| 5,254,790 | A * | 10/1993 | Thomas et al. | 585/717 |
| 6,395,945 | B1 * | 5/2002 | Randolph | 585/332 |
| 6,566,569 | B1 * | 5/2003 | Chen et al. | 585/324 |
| 7,074,976 | B2 * | 7/2006 | Powers et al. | 585/324 |
| 7,214,841 | B2 * | 5/2007 | Gartside et al. | 585/324 |
| 7,459,593 | B1 * | 12/2008 | Krupa et al. | 585/329 |
| 2007/0060781 | A1 * | 3/2007 | Goldman et al. | 585/708 |

* cited by examiner

*Primary Examiner* — Ellen McAvoy

(74) *Attorney, Agent, or Firm* — Phillips 66 Company

(57) ABSTRACT

A process for upgrading hydrocarbons comprising removal of C5 hydrocarbons from a feedstock, metathesizing said C5 hydrocarbons to C6+ and C4− hydrocarbons, and upgrading said C4− hydrocarbons is disclosed absent any dehydrogenation.

16 Claims, 1 Drawing Sheet

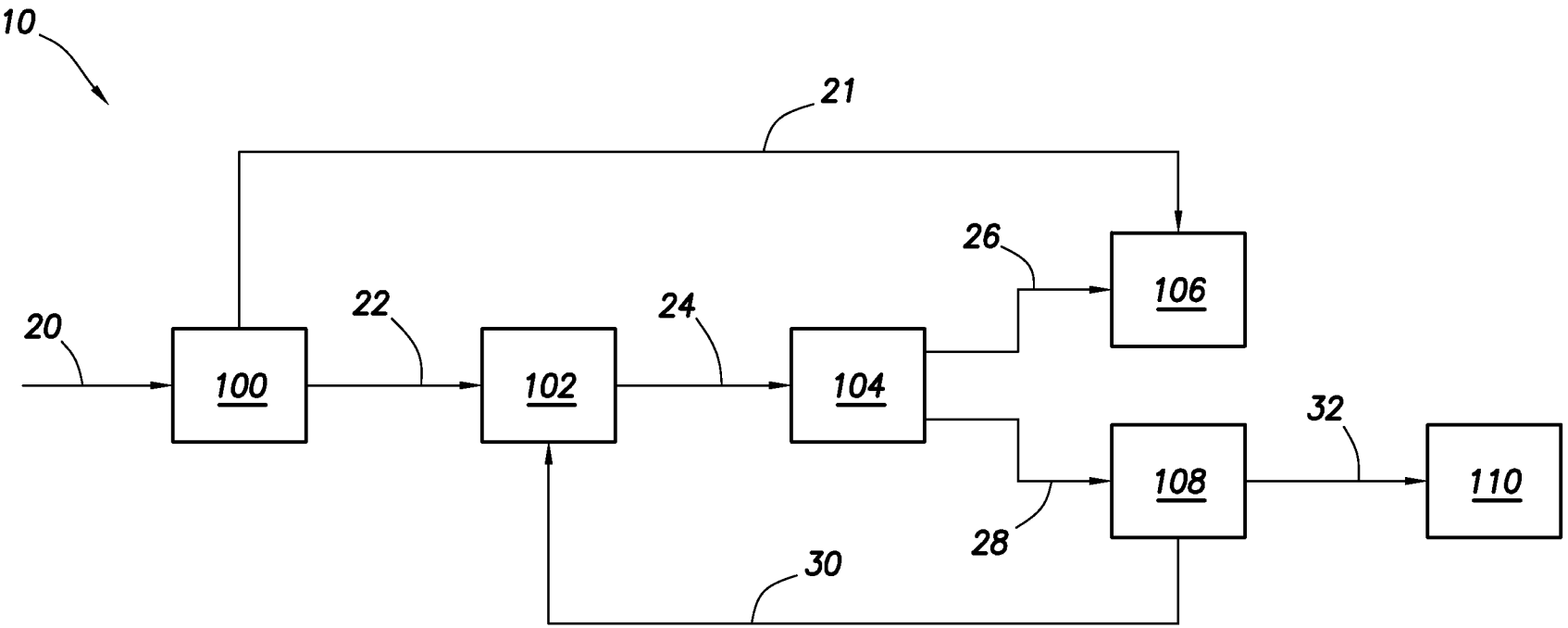
10
20
100
22
102
24
104
21
30
26
106
28
108
32
110

PROCESS FOR UPGRADING HYDROCARBONS

CROSS-REFERENCE TO RELATED APPLICATIONS

This application is a continuation-in-part application which claims benefit under 35 USC §120 to U.S. Provisional Application Ser. No. 61/109,700 filed Oct. 30, 2008, entitled "PROCESS FOR UPGRADING HYDROCARBONS" and U.S. application Ser. No. 12/607,809 filed Oct. 28, 2009, entitled "PROCESS FOR UPGRADING HYDROCARBONS", incorporated herein in their entirety.

STATEMENT REGARDING FEDERALLY SPONSORED RESEARCH OR DEVELOPMENT

None.

FIELD OF THE INVENTION

This invention relates to a process for upgrading hydrocarbons absent any dehydrogenation. More particularly, the invention relates to an improved process to provide a gasoline product with a good drivability index and a low Reid Vapor Pressure.

BACKGROUND OF THE INVENTION

Gasoline regulations limit the amount of sulfur that can be present in motor fuel.

One area of interest from automakers is the distillation index or drivability index (DI), which is a measure of gasoline tendency to vaporize. It is calculated from a gasoline's distillation profile. The specific formula for Drivability Index (DI) is DI(° F.)=1.5(T10)+3(T50)+T90. The variables T10, T50, and T90 are the temperatures (in degrees Fahrenheit) at which 10%, 50% and 90% of the fuel vaporizes, respectively, during a standard ASTM D86 distillation test. To have desirable emissions characteristics, it is preferred that the drivability index is below 1200° F.

Another area of interest from automakers is the Reid Vapor Pressure, which defined as the absolute vapor pressure of volatile crude oil and volatile non-viscous petroleum liquids. A lower Reid Vapor Pressure is desirable.

However, it is challenging to produce gasoline with both the desirable Reid Vapor Pressure and the desirable Drivability Index since Reid Vapor Pressure and Drivability Index tend to act in an opposite fashion in such that Reid Vapor Pressure decreases with an increase in T10 while DI increases with an increase in T10. For example, removal of the lighter fuel components such as nC4 and C5's will shift the T10 and T50 to higher values, resulting in an increase in the Drivability Index unless steps are taken to remove the heavier portion of the gasoline which may result in a significant lost in octane.

Therefore, a hydrocarbon upgrading process that can address the Reid Vapor Pressure and Drivability Index issues simultaneously would be a benefit to both the art and to the economy U.S. Pat. No. 6,566,569 describes a process of dehydrogenation of pentanes, conversion to C4-C6 olefins then rehydrogenation to make alkanes/isoalkanes. However the dehydrogenation process is expensive and energy intensive and there exists a need to upgrade hydrocarbons without dehydrogenation.

BRIEF SUMMARY OF THE DISCLOSURE

One aspect of the invention discloses a process for upgrading hydrocarbons. One embodiment according to the current invention comprising the following steps:

a) The hydrocarbon feedstock is passed to a first separation zone, where a first hydrocarbon stream and a remaining hydrocarbon stream are separated from the hydrocarbon feedstock. The first hydrocarbon stream comprises compounds having 5 carbon atoms per molecule (C5);

b) This first hydrocarbon stream is then passed to a metathesis reaction zone, where the first hydrocarbon stream undergoes a metathesis reaction to form metathesis reaction product stream comprising compounds having less than five carbon atoms per molecule (C4−), compounds having five carbon atoms per molecule (C5), and compounds having at least six carbon atoms per molecule (C6+);

c) The metathesis reaction product stream comprising $C_{4-}$, $C_5$ and $C_{6+}$ hydrocarbons is then passed to a second separation zone. There, the metathesis reaction product stream is separated into a second hydrocarbon stream comprising compounds having less than 6 carbon atoms per molecule (C5−) and into a third hydrocarbon stream comprising compounds having at least 6 carbon atoms per molecule (C6+);

d) The second hydrocarbon stream is then passed to a third separation zone. There, the second hydrocarbon stream is separated to form a fourth hydrocarbon stream comprising compounds having less than 5 carbon atoms per molecule (C4−) and a fifth hydrocarbon stream comprising compounds having 5 carbon atoms per molecule (C5).

e) The fourth hydrocarbon stream is passed to a hydrocarbon upgrading zone.

Another embodiment according to the current invention further comprises steps such as i) passing the third hydrocarbon stream to a gasoline blending zone; ii) recycling the fifth hydrocarbon stream to the metathesis reaction zone; iii) passing the remaining hydrocarbon stream in first separation zone to and gasoline blending zone; or any combination thereof.

The hydrocarbon feedstock according to one embodiment of the current invention may comprise compounds with 2 to 20 carbon atoms per molecule.

The hydrocarbon feedstock according to one embodiment of the current invention may contain less than 300 ppmv dienes, or less than 100 ppmv dienes. Within dienes also means di-olefins.

The hydrocarbon feedstock according to one embodiment of the current invention may contain less than 30 ppmv sulfur, or less than 10 ppmv sulfur, or less than 5 ppmv sulfur.

The upgrading zone according to one embodiment of the current invention may be an alkylation reaction zone or an oligomerization reaction zone.

The temperature in the metathesis reaction zone according to one embodiment of the current invention may be in the range of from about 700° F. to about 800° F.

The metathesis catalyst according to one embodiment of the current invention may be silica-supported tungsten oxide in conjunction with magnesium oxide.

The metathesis catalyst according to one embodiment of the current invention may be regenerated with hydrogen.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

A more complete understanding of the present invention and benefits thereof may be acquired by referring to the follow description taken in conjunction with the accompanying drawings in which:

FIG. 1 is a schematic flow diagram presenting one embodiment of the present invention.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In accordance with the present invention, a process is provided for upgrading hydrocarbon feedstock. The process involves separating C5 compound from the hydrocarbon feedstock; metathezing C5 compound to produce C4−, C5, and C6+ compounds; separating C5 and C6+ compounds; upgrading C4− compounds; and recycling C5 for metathesis.

The process described herein is an integrated process. It refers to a process which involves a sequence of steps, some of which may be parallel to other steps in the process, but which are interrelated or dependent upon either to earlier or late steps in the overall process.

Any suitable hydrocarbon feedstock can be utilized in the present inventive process. Suitable hydrocarbon feedstock may comprise, but not limited to, the compounds with 2 to 20 carbon atoms per molecule. Suitable hydrocarbon feed stock may also contain, but not limited to, less than 300 ppmv dients, or less than 100 ppmv dients. Suitable hydrocarbon feed stock may further contain, but not limited to, less than 30 ppmv sulfur, or less than 10 ppmv sulfur, or less than 5 ppmv sulfur.

The hydrocarbon feedstock is passed to a first separation zone, where first hydrocarbon comprising compounds having 5 carbon atoms per molecule and a remaining hydrocarbon stream are separated from the hydrocarbon feedstock While the remaining hydrocarbon stream is passed to a gasoline blending zone, the first hydrocarbon stream is passed to a metathesis reaction zone, where the first hydrocarbon stream undergoes a metathesis reaction. "Metathesis" refers to the interchange of carbon atoms between a pair of double bonds which is catalyzed by various metal compounds. In the present invention, the first hydrocarbon stream, which is passed into the metathesis reaction zone, is comprised of compounds having 5 carbon atoms per molecule, and the metathesis reaction product stream is comprised of olefins having either 4, 5, or 6 carbon atoms per molecule.

Any suitable metathesis catalyst can be utilized in the metathesis reaction zone. Suitable catalysts include, but are not limited to, transition metal halides or oxides with an alkylating co-catalyst, titanocene-based catalysts, ruthenium catalysts supported by phosphine ligands, and tungsten and/or molybdenum-containing catalysts. Other suitable catalysts are described, for example, in U.S. Pat. Nos. 4,522,936 and 4,071,471, the contents of which are incorporated herein by reference. The catalyst according to an embodiment of the current invention is silica-supported tungsten oxide in conjunction with magnesium oxide. The catalyst according to an embodiment of the current invention may be regenerated by the use of hydrogen.

The temperature in the metathesis reaction zone depends on the type of catalyst used. For one embodiment where a tungsten oxide/magnesium oxide catalyst is used, the temperature in the metathesis reaction zone will be within the range of from about 700° F. to about 800° F.

The metathesis reaction product stream comprising $C_4$, $C_5$ and $C_6$ olefins is then passed to a second separation zone. There, the metathesis reaction product stream is then separated into a second hydrocarbon stream comprising compounds having less than 6 carbon atoms per molecule and into a third hydrocarbon stream comprising compounds having at least 6 carbon atoms per molecule.

The second hydrocarbon stream is then passed to a third separation zone. There, the second hydrocarbon stream is separated to form a fourth hydrocarbon stream comprising compounds having less than 5 carbon atoms per molecule and a fifth hydrocarbon stream comprising compounds having 5 carbon atoms per molecule.

With the third hydrocarbon stream being passed to a gasoline blending zone and the fifth hydrocarbon stream being recycled back to the metathesis reaction zone for metathesis reaction as described above, the fourth hydrocarbon stream is passed to a hydrocarbon upgrading zone where the C4− compounds undergoes a hydrocarbon upgrading process.

The hydrocarbon upgrading zone according to one embodiment of the present invention may be an alkylation reaction zone, where the C4− compounds undergoes an alkylation reaction. Suitable alkylation reaction unit, condition and catalysts used therefore, are described, for example, in U.S. Pat. Nos. 6,395,945 and 5,254,790, the contents of which are incorporated herein by reference.

The hydrocarbon upgrading zone may also be an oligomerization reaction zone, where the C4− compounds undergoes an oligomerization reaction and produces higher octane low RVP gasoline blend.

Any suitable separation method may be used in any of the separation zones of the present invention mentioned above, suitable method may be, but not limited to, fractional distillation.

The lack of dehydrogenation in our process would allow the conversion of gasoline components without the expense of dehydrogenation equipment and the subsequent extra energy input required for the highly endothermic dehydrogenation process. The product of C6 olefins can be blended directly into the gasoline pool and the C4 olefins can be used as an alkylation feed. In one embodiment the C6 olefins can be fed into a gasoline pool and restore lost octane from C5's while keeping the Reid Vapor Pressure down. The C4 olefins can be utilized as feedstocks to alkylation and/or oligomerization units to provide high octane blendstocks and will help offset lower volumes of light olefins that would result from lowering the FCC severity. A dehydrogenation process, especially a direct dehydrogenation process would require additional operating expense and significant energy input.

Now referring to FIG. 1, a process system 10 is depicted which comprises the following steps.

A hydrocarbon feedstock is passed to a first separation zone 100 via conduit 20. The feedstock is separated into first hydrocarbon stream comprising compounds having 5 carbon atoms per molecule and a remaining hydrocarbon stream without C5 components. The remaining hydrocarbon stream without the $C_5$ components passes to gasoline blending zone 106 via conduit 21. The first hydrocarbon stream then passes into metathesis reaction zone 102 via conduit 22 to form a metathesis reaction product stream which passes into a second separation zone 104 via conduit 24. In second separation zone 104, the metathesis reaction product stream is separated into a second hydrocarbon stream and a third hydrocarbon stream. The third hydrocarbon stream comprises compounds having at least six carbon atoms per molecule and it passes through conduit 26 to gasoline blending zone 106. The second hydrocarbon stream comprises compounds having 5 or less carbon atoms per molecule. It passes through conduit 28 to third separation zone 108. There, the second hydrocarbon stream is separated into a fourth hydrocarbon stream comprising compounds having less than 5 carbon atoms per molecule and a fifth hydrocarbon product stream comprising compounds having 5 carbon atoms per molecule. The fifth hydrocarbon product stream returns to metathesis reaction zone 102 via conduit 30. The fourth hydrocarbon product stream passes via conduit 32 to hydrocarbon upgrading zone 110 wherein dehydrogenation reactions do not occur.

The following examples are presented to further illustrate this invention and are not to be construed as unduly limiting the invention as set out in the specification and the appended claims.

EXAMPLE I

A 5.33-gram quantity of an $MgO/WO_3/SiO_2$ metathesis catalyst was contacted with a feed comprising the components listed below in Table I at a feed rate of 40 ml/hr. The weight hourly space velocity (WHSV) was 4.6 $hr^{-1}$ and the liquid hourly space velocity (LHSV) was 3.6 $hr^{-1}$. The temperature set point was 700° F. Results (on wt % basis) were measured hourly and are shown in Table I.

TABLE I

| Catalyst: | | $MgO/WO_3/SiO_2$ Metathesis Catalyst | | |
|---|---|---|---|---|
| Catalyst Weight, g | 5.33 | 11 cc catalyst volume | | |
| WHSV ($hr^{-1}$) | 4.8 | 1.17 olefin only | | |
| Feed Rate (mL/hr) | 40 | 24.71 g/hr feed | | |
| LHSV ($hr^{-1}$) | 3.6 | | | |
| Temp Set Pt, ° F. | | 700 | 700 | 700 |
| Component | Feed #1 | Prod 1 | Prod 2 | Prod 3 |
| Ethylene | | 0.065 | 0.071 | 0.028 |
| Propane | 0.000 | 0.000 | 0.000 | 0.000 |
| Propylene | 0.008 | 1.238 | 1.180 | 0.599 |
| Isobutane | 0.078 | 0.097 | 0.080 | 0.075 |
| Isobutene | 0.533 | 2.088 | 1.953 | 1.257 |
| Normal Butane | 0.571 | 0.561 | 0.564 | 0.554 |
| 2-butene trans | 0.384 | 1.425 | 1.417 | 0.966 |
| 2-butene cis | 0.304 | 0.959 | 1.009 | 0.694 |
| 3-methyl butene-1 | 1.258 | 0.487 | 0.511 | 0.639 |
| Isopentane | 48.171 | 49.000 | 49.082 | 48.697 |
| Isopentene | 3.204 | 1.059 | 1.195 | 1.732 |
| 2-methyl butene-1 | 8.523 | 3.639 | 3.831 | 4.435 |
| Normal Pentane | 13.220 | 13.577 | 13.386 | 13.259 |
| Trans-2-pentene | 9.619 | 4.270 | 5.207 | 6.995 |
| Cis-2-pentene | 4.502 | 2.167 | 2.557 | 3.419 |
| 2-methyl butene-2 | 8.552 | 9.029 | 9.772 | 11.353 |
| Unknown $C_1$-$C_5$ | 0.187 | 0.001 | 0.001 | 0.001 |
| $C_6^+$ | 0.000 | 10.403 | 8.255 | 5.325 |
| Total | 99.114 | 100.000 | 100.000 | 100.000 |
| Total C5= Conv | | 42.086 | 35.294 | 19.869 |
| C4= Selectivity | | 21.663 | 25.093 | 23.938 |
| C6+ Selectivity | | 69.320 | 65.592 | 75.160 |

EXAMPLE II

The catalyst in Example I was then purged overnight with nitrogen at a rate of 50 sccm. The metathesis reaction was then run again with the same conditions as Example I, except that the temperature set point was 760° F. The results (on wt % basis) were once again measured and are shown in Table II.

TABLE II

| | Temp. Set Pt, ° F. | | | | |
|---|---|---|---|---|---|
| | 760 Prod 4 | 760 Prod 5 | 760 Prod 6 | 760 Prod 7 | 760 Prod 8 |
| Ethylene | 0.092 | 0.075 | 0.100 | 0.073 | 0.066 |
| Propane | 0.000 | 0.000 | 0.000 | 0.000 | 0.000 |
| Propylene | 1.579 | 1.271 | 1.514 | 1.201 | 1.108 |
| Isobutane | 0.077 | 0.075 | 0.076 | 0.075 | 0.075 |
| Isobutene | 2.212 | 1.958 | 2.225 | 1.861 | 1.740 |
| Normal Butane | 0.553 | 0.555 | 0.558 | 0.552 | 0.552 |
| 2-butene trans | 1.635 | 1.466 | 1.635 | 1.409 | 1.341 |
| 2-butene cis | 1.193 | 1.073 | 1.193 | 1.034 | 0.986 |
| 3-methyl butene-1 | 0.508 | 0.572 | 0.495 | 0.589 | 0.628 |
| Isopentane | 47.888 | 48.778 | 48.718 | 48.713 | 48.697 |
| Isopentene | 0.874 | 1.109 | 0.899 | 1.176 | 1.273 |
| 2-methyl butene-1 | 3.781 | 4.156 | 3.944 | 4.228 | 4.325 |
| Normal Pentane | 13.099 | 13.359 | 13.318 | 13.353 | 13.352 |
| Trans-2-pentene | 3.776 | 4.615 | 4.023 | 4.806 | 5.047 |
| Cis-2-pentene | 1.905 | 2.322 | 2.029 | 2.422 | 2.552 |
| 2-methyl butene-2 | 9.178 | 9.953 | 9.451 | 10.164 | 10.419 |
| Unknown $C_1$-$C_5$ | 0.002 | 0.003 | 0.005 | 0.006 | 0.004 |
| $C_6^+$ | 11.740 | 8.734 | 9.917 | 8.413 | 7.902 |
| Total | 100.000 | 100.000 | 100.000 | 100.000 | 100.000 |
| Total C5= Conv | 43.850 | 36.264 | 41.553 | 34.419 | 32.010 |
| C4= Selectivity | 24.419 | 25.334 | 25.863 | 25.119 | 24.931 |
| C6+ Selectivity | 75.083 | 67.540 | 66.928 | 68.546 | 69.233 |

EXAMPLE III

The catalyst was then regenerated with a nitrogen/hydrogen combination flow at a rate of 50 sccm for one hour. This was followed by a 50 sccm nitrogen purge overnight. The metathesis reaction was run, with the reaction conditions the same as in Example II. The results (on wt % basis) are shown in Table III.

TABLE III

| | Temp Set Pt, ° F. | | | |
|---|---|---|---|---|
| | 760 Prod 9 | 760 Prod 10 | 760 Prod 11 | 760 Prod 12 |
| Ethylene | 0.085 | 0.089 | 0.015 | 0.045 |
| Propane | 0.000 | 0.000 | 0.000 | 0.000 |
| Propylene | 1.503 | 1.191 | 0.313 | 0.782 |
| Isobutane | 0.075 | 0.081 | 0.072 | 0.074 |
| Isobutene | 2.202 | 1.946 | 0.905 | 1.398 |
| Normal Butane | 0.553 | 0.557 | 0.542 | 0.550 |
| 2-butene trans | 1.668 | 1.347 | 0.661 | 1.041 |
| 2-butene cis | 1.225 | 0.972 | 0.482 | 0.770 |
| 3-methyl butene-1 | 0.523 | 0.753 | 0.799 | 0.684 |
| Isopentane | 48.784 | 48.746 | 48.599 | 48.603 |
| Isopentene | 0.886 | 1.629 | 2.199 | 1.579 |
| 2-methyl butene-1 | 3.903 | 3.987 | 4.836 | 4.628 |
| Normal Pentane | 13.406 | 13.275 | 13.240 | 13.233 |
| Trans-2-pentene | 3.779 | 5.827 | 8.356 | 6.485 |
| Cis-2-pentene | 1.906 | 2.678 | 4.044 | 3.183 |
| 2-methyl butene-2 | 9.456 | 9.231 | 11.770 | 11.113 |
| Unknown $C_1$-$C_5$ | 0.003 | 0.004 | 0.002 | 0.003 |
| $C_6^+$ | 10.127 | 7.777 | 3.180 | 5.875 |
| Total C5= Conv | 42.641 | 32.399 | 10.427 | 22.396 |
| C4= Selectivity | 25.475 | 26.346 | 22.627 | 24.888 |
| C6+ Selectivity | 66.605 | 67.317 | 87.034 | 73.567 |

EXAMPLE IV

Table IV below shows data for gasoline which has been depentanized, the "Kettle Product." The "Full Range" category denotes gasoline which also includes the $C_5$ components.

TABLE IV

| Gasoline De-pentanization | | |
|---|---|---|
| Gasoline Fraction | Full Range | Kettle Product |
| RON | 89.3 | 88.5 |
| MON | 80.1 | 79.1 |
| Rvp (psia @ 100° F.) | 4.82 | 2.27 |
| D-86 Data (° F.) | | |
| Initial Boiling Point | 115 | 156 |
| T10 | 162 | 191 |
| T50 | 255 | 268 |
| T90 | 388 | 389 |
| DI (calculated) | 1396 | 1479 |
| *DHA Results, vol % | | |
| C4 minus | 0.230 | 0 |
| C5 | 10.992 | 1.972 |
| C6+ | 88.778 | 98.028 |

Based on these data, the C5 fraction removed from gasoline has blending RON of 95.8, blending MON of 88.2 and blending Rvp of 25.5; Measured C5 Rvp - 17.36 psig.
[*DHA = Detailed Hydrocarbon Analysis]

While this invention has been described in detail for the purpose of illustration, it should not be construed as limited thereby but intended to cover all changes and modifications within the spirit and scope thereof. Reasonable variations, modifications, and adaptations can be made within the scope of the disclosure and the appended claims without departing from the scope of this invention.

REFERENCES

All of the references cited herein are expressly incorporated by reference. Incorporated references are listed again here for convenience:

1. U.S. Pat. No. 4,071,471 (Banks et al) "Catalysts for Conversion of Olefins", granted Jan. 31, 1978.
2. U.S. Pat. No. 4,522,936 (Kubes et al) "Metathesis Catalyst", granted Jan. 11, 1985.
3. U.S. Pat. No. 5,254,790 (Thomas et al) "Integrated Process for Producing Motor Fuels", granted Oct. 19, 1993.
4. U.S. Pat. No. 6,395,945 (Randolph) "Integrated Hydroisomerization Alkylation Process", grant May 28, 2002.

What is claimed is:

1. A process for upgrading hydrocarbons comprising:

a) separating a first hydrocarbon stream and a remaining hydrocarbon stream from a hydrocarbon feedstock in a first separation zone, wherein said first hydrocarbon stream comprises compounds having five carbon atoms per molecule (C5);

b) reacting said first hydrocarbon stream in a metathesis reaction zone to form a metathesis reaction product stream, wherein said metathesis reaction product stream comprises compounds having less than five carbon atoms per molecule (C4−), compounds having five carbon atoms per molecule (C5), and compounds having at least six carbon atoms per molecule ($C_{6+}$);

c) separating a second hydrocarbon stream and a third hydrocarbon stream from said metathesis reaction product stream in a second separation zone, wherein said second hydrocarbon stream comprises compounds having less than six carbon atoms per molecule (C5−) and wherein said third hydrocarbon stream comprises compounds having at least six carbon atoms per molecule (C6+);

d) separating a fourth hydrocarbon stream and a fifth hydrocarbon stream from said second hydrocarbon stream in a third separation zone, wherein said fourth hydrocarbon stream comprising compounds having less than 5 carbon atoms per molecule (C4−) and said fifth hydrocarbon stream comprising compounds having 5 atoms per molecule (C5); and e) reacting said fourth hydrocarbon stream in a hydrocarbon upgrading zone wherein said process does not comprise dehydrogenation reactions.

2. The process in according with claim 1 further comprising step selected from a list of steps consisting of i) passing said third hydrocarbon stream to a gasoline blending zone; ii) recycling said fifth hydrocarbon stream to said metathesis reaction zone; iii) passing said remaining hydrocarbon stream in first separation zone to said gasoline blending zone; and any combination thereof.

3. A process in accordance with claim 1 wherein said hydrocarbon upgrading zone is an alkylation reaction zone.

4. A process in accordance with claim 1 wherein said hydrocarbon upgrading zone is an oligomerization reaction zone.

5. A process in accordance with claim 1 wherein said metathesis reaction conditions include a reaction temperature in the range of from about 700° F. to about 800° F.

6. A process in accordance with claim 1 wherein said metathesis reaction conditions include a metathesis catalyst.

7. A process in accordance with claim 6 wherein said metathesis catalyst comprises silica, tungsten oxide, and magnesium oxide.

8. A process in accordance with claim 6 wherein said metathesis catalyst is regenerated with hydrogen.

9. A process in accordance with claim 1 wherein said hydrocarbon feedstock comprises compounds with 2 to 20 carbon atoms per molecule.

10. A process in accordance with claim 1 wherein said hydrocarbon feedstock contains less than 300 ppmw dienes.

11. A process in accordance with claim 1 wherein said hydrocarbon feedstock contains less than 100 ppmw dienes.

12. A process in accordance with claim 1 wherein said hydrocarbon feedstock contains less than 30 ppmw sulfur.

13. A process in accordance with claim 1 wherein said hydrocarbon feedstock contains less than 10 ppmw sulfur.

14. A process in accordance with claim 1 wherein said hydrocarbon feedstock contains less than 5 ppmw sulfur.

15. A process in accordance with claim 1, wherein said fourth hydrocarbon stream is fed into an alkylation unit to provide high octane blendstocks.

16. A hydrocarbon product stream prepared by the steps of:

a) separating a first hydrocarbon stream and a remaining hydrocarbon stream from a hydrocarbon feedstock in a first separation zone, wherein said first hydrocarbon stream comprises compounds having five carbon atoms per molecule (C5);

b) reacting said first hydrocarbon stream in a metathesis reaction zone to form a metathesis reaction product stream, wherein said metathesis reaction product stream comprises compounds having less than five carbon atoms per molecule (C4−), compounds having five carbon atoms per molecule (C5), and compounds having at least six carbon atoms per molecule ($C_{6+}$);

c) separating a second hydrocarbon stream and a third hydrocarbon stream from said metathesis reaction product stream in a second separation zone, wherein said second hydrocarbon stream comprises compounds having less than six carbon atoms per molecule (C5−) and wherein said third hydrocarbon stream comprises compounds having at least six carbon atoms per molecule (C6+);

d) separating a fourth hydrocarbon stream and a fifth hydrocarbon stream from said second hydrocarbon stream in a third separation zone, wherein said fourth hydrocarbon stream comprising compounds having less than 5 carbon atoms per molecule (C4−) and said fifth hydrocarbon stream comprising compounds having 5 atoms per molecule; and e) Reacting said fourth hydrocarbon stream in a hydrocarbon upgrading zone wherein said process does not comprise dehydrogenation reactions do not occur.

* * * * *